US008100519B2

(12) United States Patent
Hirashima

(10) Patent No.: US 8,100,519 B2
(45) Date of Patent: Jan. 24, 2012

(54) LIQUID DISCHARGING HEAD, LIQUID DISCHARGING APPARATUS, AND BUBBLE REMOVING METHOD FOR THE LIQUID DISCHARGING APPARATUS

(75) Inventor: Shigeyoshi Hirashima, Kanagawa (JP)

(73) Assignee: Sony Corporation, Tokyo (JP)

( * ) Notice: Subject to any disclaimer, the term of this patent is extended or adjusted under 35 U.S.C. 154(b) by 943 days.

(21) Appl. No.: 12/052,384

(22) Filed: Mar. 20, 2008

(65) Prior Publication Data

US 2008/0239013 A1 Oct. 2, 2008

(30) Foreign Application Priority Data

Mar. 30, 2007 (JP) ..... 2007-090862

(51) Int. Cl.
*B41J 2/18* (2006.01)

(52) U.S. Cl. ..... 347/89

(58) Field of Classification Search ..... None
See application file for complete search history.

(56) References Cited

U.S. PATENT DOCUMENTS

2008/0239014 A1* 10/2008 Hirashima et al. ..... 347/65

FOREIGN PATENT DOCUMENTS

JP 11179932 A * 7/1999
JP 11-342634 12/1999
JP 11342634 A * 12/1999

* cited by examiner

*Primary Examiner* — Matthew Luu
*Assistant Examiner* — Erica Lin
(74) *Attorney, Agent, or Firm* — SNR Denton US LLP

(57) ABSTRACT

A liquid discharging head includes a head chip including a plurality of energy generating elements configured to discharge liquid, and liquid chambers provided around the energy generating elements, and a common passage member configured to define a common passage communicating with all the liquid chambers. Liquid is discharged from the liquid chambers by driving the energy generating elements so as to apply a discharging force to the liquid. N-number of common passage members (N≧2) are provided, and each includes an inlet for supplying the liquid to the common passage and an outlet for ejecting the liquid from the common passage. The inlet of the first common passage member is connected to a liquid supply member. The inlet of the N-th common passage member is connected to the liquid supply member via an opening-closing valve and to the outlet of the (N−1)-th common passage member.

7 Claims, 9 Drawing Sheets

[DURING INK SUPPLY]

[DURING INK DISCHARGING]

[DURING REMOVAL OF BUBBLES FROM MANIFOLD]

[DURING REMOVAL OF BUBBLES FROM BUFFER TANK]

LIQUID DISCHARGING HEAD, LIQUID DISCHARGING APPARATUS, AND BUBBLE REMOVING METHOD FOR THE LIQUID DISCHARGING APPARATUS

CROSS REFERENCES TO RELATED APPLICATIONS

The present invention contains subject matter related to Japanese Patent Application JP 2007-090862 filed in the Japanese Patent Office on Mar. 30, 2007, the entire contents of which are incorporated herein by reference.

BACKGROUND OF THE INVENTION

1. Field of the Invention

The present invention relates to a liquid discharging head and a liquid discharging apparatus which include a plurality of common passage members that define common passages communicating with all liquid chambers in head chips and which discharge liquid from the liquid chambers by driving energy generating elements of the head chips so as to apply a discharging force to the liquid in the liquid chambers, and to a bubble removing method for the liquid discharging apparatus. More particularly, the present invention relates to a technique of stably supplying liquid to the common passages of the common passage members and of smoothly removing bubbles from the liquid in the common passages.

2. Description of the Related Art

In an inkjet printer as an example of a liquid discharging apparatus, a recording sheet is conveyed to a liquid discharging head, and ink (liquid) is discharged for printing on the recording sheet by driving a heating resistor (energy generating element) in an ink chamber (liquid chamber) of a head chip that constitutes the liquid discharging head. In this inkjet printer, it is necessary to stably supply ink stored in an ink cartridge to the ink chamber of the head chip.

Water-based ink and oil-based ink can be discharged. Particularly when water-based ink is used, air dissolved in the ink sometimes form bubbles, for example, because of a temperature change, or air taken from the outside sometimes remains as bubbles in the ink. If these bubbles accumulate near the head chip, the flow of ink to the ink chamber is hindered, and sufficient ink supply is difficult during printing. For this reason, the bubbles in the ink disturb the ink discharging direction and change the ink discharging amount.

Ink is discharged by the application of a discharging force from the heating resistor in the head chip to the ink in the ink chamber. If a bubble exists in the ink, it weakens the ink discharging force because of gas compressibility, and disturbs the ink discharging direction. Further, if the bubble in the ink is expanded in accordance with the installation environment of the inkjet printer, the temperature change due to ink discharging (driving of the heating resistor), or the change in atmospheric pressure, the ink in the ink chamber is sometimes unintentionally discharged from the nozzle.

In order to overcome the above problems due to the existence of bubbles in the ink, various technologies for removing bubbles from the ink have been proposed. For example, in the case of a line printer which performs printing corresponding to the width of the recording sheet with nozzles arranged over the length corresponding to the width of the recording sheet, the number of prints is large and good durability is necessary. For this reason, bubbles near the head chip are removed from the ink by being circulated together with the ink by a transfer means such as a pump.

In this bubble removing method, bubbles can be removed with the flow of ink in the common passage communicating with all ink chambers of the head chip. That is, ink is ejected from an outlet of a buffer tank (common passage member) that defines the common passage while supplying ink from an inlet of the buffer tank, so that bubbles are removed from the common passage together with the ink.

However, when in a module-type line head (line printer) that can perform printing corresponding to the width of a recording sheet with a plurality of head modules each including a head chip and a buffer tank, there is a problem with a method for supplying and ejecting ink to and from each buffer tank. That is, it is necessary to remove bubbles from the ink in common passages of all buffer tanks. The ink can be supplied to and ejected from the common passages by some routes.

In one bubble removing method using parallel connection, an ink supply member is connected to an inlet of each buffer tank so as to directly supply ink to common passages of all buffer tanks, and ink is directly ejected from an outlet of each buffer tank. For example, Japanese Unexamined Patent Application Publication No. 11-342634 discloses a line printer in which inks in common passages of all buffer tanks are circulated in parallel by one pump so that bubbles are simultaneously removed from all the common passages.

SUMMARY OF THE INVENTION

Unfortunately, it is difficult for the line printer disclosed in the above-described publication to sufficiently remove bubbles from the ink. That is, even when inks in the common passages of all buffer tanks are circulated in parallel by one pump in order to remove bubbles, they are not circulated in the same manner, but only ink that is easy to be ejected from an outlet (ink containing few bubbles) is preferentially circulated in the buffer tanks. For this reason, in the parallel connection method, essential ink, which contains a lot of bubbles, is not sufficiently circulated, and as a result, removal of bubbles is insufficient.

FIG. 8 is a conceptual view showing a line printer 100 that removes bubbles by this parallel connection method as the related art.

As shown in FIG. 8, the line printer 100 includes a module-type line head 110 in which two head modules 120 and 130 are arranged, a pump 11 that transfers ink, a subtank 12 that adjusts the pressure of ink to be supplied to the line head 110, and an ink cartridge 13 that stores the ink to be supplied to the line head 110. The subtank 12 is provided with a communication valve 14 that allows the interior of the subtank 12 to communicate with the atmosphere.

The head module 120 (130) includes a plurality of head chips 160 (170) for discharging the ink, and a buffer tank 121 (131) that defines a common passage communicating with all ink chambers in the head chips 160 (170). The buffer tank 121 (131) includes an inlet 122 (132) through which ink is supplied to the common passage, and an outlet 123 (133) through which ink is ejected from the common passage.

A supply tube 181 for supplying ink from the subtank 12 to the buffer tank 121 (131) is connected to the inlet 122 (132) of the buffer tank 121 (131), and an ejection tube 182 for ejecting ink from the buffer tank 121 (131) is connected to the outlet 123 (133). The ejection tube 182 is connected to the pump 11 via a circulation-side section 15*a* of a switch valve 15 and a first communication tube 16. The pump 11 is connected to the subtank 12 via a second communication tube 17. For this reason, ink is circulated by driving the pump 11, as shown by the arrows in FIG. 8. A supply-side section 15*b* of the switch valve 15 is connected to a connecting tube 18 for supplying ink stored in the ink cartridge 13.

In the line printer 100 shown in FIG. 8, for example, even when ink in the common passage of the buffer tank 121 contains bubbles, it is circulated by driving the pump 11, and is transferred to the subtank 12 via the outlet 123. The bubbles in the ink are released into the atmosphere via the communication valve 14 of the subtank 12. For this reason, ink supplied from the subtank 12 to the common passage of the buffer tank 121 does not contain a bubble, and as a result, bubbles are removed from the ink in the common passage of the buffer tank 121.

However, when the bubbles in the ink form an air accumulation and the air accumulation partially blocks the common passage in the buffer tank 121, the ink transfer resistance increases. Therefore, even when ink in the subtank 12 is supplied to the inlet 122 of the buffer tank 121 and the inlet 132 of the buffer tank 131 with the same pressure via the supply tube 181 by the pump 11, ink transfer in the buffer tank 121 is hindered by the resistance at the air accumulation.

In contrast, while some pressure loss occurs in the buffer tank 131, there is no resistance due to an air accumulation. Therefore, the ink supplied from the inlet 132 is transferred in accordance with the supply pressure, and is smoothly ejected from the outlet 133. The ejected ink is transferred to the subtank 12 via the ejection tube 182, the circulation-side section 15*a* of the switch valve 15, the first communication tube 16, the pump 11, and the second communication tube 17.

In this way, while the ink smoothly circulates and bubbles are removed in the common passage of the buffer tank 131, the ink stays in the common passage of the buffer tank 121 because of the resistance at the air accumulation, and little ink is ejected from the outlet 123. For this reason, the ink rarely circulates, and bubbles are not sufficiently removed from the ink in the common passage of the buffer tank 121.

Therefore, in the line printer 100 shown in FIG. 8 in which bubbles are removed by parallel connection, even when th inks in the common passages of the buffer tanks 121 and 131 are circulated by the same pump 11 in order to remove bubbles, the ink in one of the buffer tanks 121 and 131 that contain fewer bubbles is preferentially circulated. Consequently, bubbles are not smoothly removed from the line head 110.

Accordingly, it is conceivable to circulate ink in series by series connection so that ink in only one of the buffer tanks does not circulate preferentially.

FIG. 9 is a conceptual view showing a line printer 200 serving as a comparative example in which bubbles are removed by series connection.

As shown in FIG. 9, the line printer 200 includes a module-type line head 210 in which two head modules 220 and 230 are arranged. The head module 220 (230) includes a plurality of head chips 260 for discharging ink, and a buffer tank 230 (231) that defines a common passage communicating with all ink chambers in the head chips 260.

A supply tube 281 for supplying ink to the line head 210 is connected only to an inlet 222 of the buffer tank 221. A series tube 283 is connected between an outlet 223 of the buffer tank 221 and an inlet 232 of the buffer tank 231. An ejection tube 282 is connected to an outlet 233 of the buffer tank 231. For this reason, the buffer tank 221 and the buffer tank 231 are connected in series in the line printer 200 shown in FIG. 9. Other components, namely, a pump 11, a subtank 12, an ink cartridge 13, a communication valve 14, a switch valve 15, a first communication tube 16, a second communication tube 17, and a connecting tube 18 are the same as those adopted in the line printer 100 shown in FIG. 8.

In this line printer 200 shown in FIG. 9, when ink in the subtank 12 is supplied to the common passage of the buffer tank 21 via the supply tube 281 and the inlet 222 by driving the pump 11, ink containing bubbles in the buffer tank 221 is transferred in accordance with the supply pressure, and is ejected from the outlet 223. The ejected ink is then supplied to the common passage of the buffer tank 231 via the series tube 283 and the inlet 232. Therefore, ink in the buffer tank 231 is also transferred in accordance with the supply pressure, and is ejected from the outlet 233. The ejected ink returns to the subtank 12 via the ejection tube 282, a circulation-side section 15*a* of the switch valve 15, the first communication tube 16, the pump 11, and the second communication tube 17, and bubbles are removed from the ink at the subtank 12.

Therefore, in the line printer 200 of the series connection type, ink is circulated in series by driving the pump 11, as shown by the arrows in FIG. 9, so that bubbles are removed from the ink. That is, bubbles contained in the ink in the common passage of the buffer tank 221 are transferred to the subtank 12 via the common passage of the buffer tank 231, and are removed by being released into the atmosphere. Even when ink in the common passage of the buffer tank 231 contains bubbles, the bubbles are transferred to the subtank 12 and are then removed. Even when the bubbles in the ink form an air accumulation, the ink in the common passage of the buffer tank 221 and the ink in the common passage of the buffer tank 231 similarly circulate. This allows smooth removal of bubbles in the line head 210.

However, the case of series connection, on the downstream side of the head module 220 to which ink is first supplied, the pressure loss is increased by the influence of the pressure on the upstream side and the increase in the length of the ink transfer path, and the pressure easily fluctuates. Therefore, stable ink supply is difficult.

This problem will be described in detail. As shown in FIG. 9, the pressure in the line head 210 gradually decreases because of pressure loss in the head module 220 to which ink is first supplied. The pressure in the downstream head module 230 is lower from the start than the pressure reduced in the head module 220, because pressure loss due to the series tube 283 is added. The pressure in the head module 230 further gradually decreases because of pressure loss. For this reason, the pressure in the latter head module, of the head modules connected in series, is much lower than the pressure in the former head module.

In the line head 210, the ink consumption amount frequently differs between the head module 220 and the head module 230. For this reason, it is necessary to stably supply ink to each of the head modules 220 and 230 in accordance with the ink consumption amount. However, since the pressure in the latter head module 230 is low in the case of series connection, ink is not supplied stably. As a result, a difference is formed between the ink discharging performance of the head chips 260 in the former head module 220 and the ink discharging performance of the head chips 270 in the latter head module 230.

In the line printer 100 of the parallel connection type shown in FIG. 8, even when the ink consumption amount differs between the head module 120 and the head module 130 in the line head 110, ink can be directly supplied to the respective head modules 120 and 130. For this reason, the head module 120 and the head module 130 display just the same tendency, although the pressures therein are decreased by pressure loss. As a result, ink is stably supplied to both the head modules 120 and 130 with a similar pressure.

While stable ink supply is thus possible in the line printer 100 of the parallel connection type shown in FIG. 8, bubbles are removed insufficiently. Conversely, while bubbles can be smoothly removed in the line printer 200 of the series connection type shown in FIG. 9, ink supply is not stable.

Accordingly, it is desirable to stably supply liquid (ink) to each common passage for the liquid and to smoothly remove bubbles from the liquid in the common passage.

A liquid discharging head according to an embodiment of the present invention includes a head chip including a plurality of energy generating elements configured to discharge liquid, and liquid chambers provided around the corresponding energy generating elements; and a common passage member configured to define a common passage communicating with all the liquid chambers in the head chip. The liquid is discharged from the liquid chambers by driving the energy generating elements so as to apply a discharging force to the liquid in the liquid chambers. The common passage member includes N-number of common passage members, the value N is more than or equal to two, and each of the common passage members includes an inlet through which the liquid is supplied to the common passage and an outlet through which the liquid is ejected from the common passage. The inlet of the first common passage member is connected to a liquid supply member. The inlet of the N-th common passage member is connected to the liquid supply member via an opening-closing valve and to the outlet of the (N−1)-th common passage member.

A liquid discharging apparatus according to another embodiment of the present invention includes the above-described liquid discharging head, and transfer means configured to transfer the liquid from the inlet of the first common passage member toward the outlet of the N-th common passage member.

A bubble removing method according to a further embodiment of the present invention is provided for a liquid discharging apparatus. The liquid discharging apparatus includes a head chip including a plurality of energy generating elements configured to discharge liquid and liquid chambers provided around the corresponding energy generating elements; N-number of common passage members each configured to define a common passage communicating with all the liquid chambers in the head chip and each including an inlet through which the liquid is supplied to the common passage and an outlet through which the liquid is ejected from the common passage, the value N being more than or equal to two; and transfer means configured to transfer the liquid from the inlet of the first common passage member toward the outlet of the N-th common passage member. A bubble is removed from the liquid in the common passages of the common passage members by transferring the liquid by the transfer means. The inlet of the first common passage member is connected to a liquid supply member. The inlet of the N-th common passage member is connected to the ink supply member via an opening-closing valve and to the outlet of the (N−1)-th common passage member. The liquid is transferred by driving the transfer means while the opening-closing valve is opened when the liquid is discharged from the liquid chambers by driving the energy generating elements in the head chip so as to apply a discharging force to the liquid in the liquid chambers. The liquid is transferred by driving the transfer means while the opening-closing valve is closed when the bubble is removed from the liquid in the common passages of the common passage members.

In the above embodiments of the present invention, each of the N-number (N≧2) of common passage members includes the inlet through which the liquid is supplied to the common passage, and the outlet through which the liquid is ejected from the common passage. The liquid supply member is connected to the inlet of the first common passage member. The inlet of the N-th common passage member is connected to the liquid supply member via the opening-closing valve and to the outlet of the (N−1)-th common passage member. For this reason, the common passage members are connected in parallel by opening the opening-closing valve, and are connected in series by closing the opening-closing valve.

According to the embodiments of the present invention, the common passage members are connected in parallel by opening the opening-closing valve. Therefore, when the liquid in the liquid chambers is discharged by driving the energy generating elements in the head chip, stable ink supply can be achieved by transferring the liquid by driving the transfer means with the opening-closing valve open. Further, the common passage members are connected in series by closing the opening-closing valve. Therefore, bubbles can be smoothly removed from the liquid in the common passages of all the common passage members by transferring the liquid by driving the transfer means with the opening-closing valve closed. As a result, it is possible to achieve both stable ink supply and smooth removal of bubbles.

DESCRIPTION OF THE PREFERRED EMBODIMENTS

An embodiment of the present invention will be described below with reference to the drawings.

In the following embodiment, a color inkjet printer (line printer 1) that discharges inks (liquids) of four colors, Y (yellow), M (magenta), C (cyan), and K (black) will be described as an example of a liquid discharging apparatus according to the present invention. A line head 10 used in the line printer 1 corresponds to a liquid discharging head in the present invention.

Figure 1:
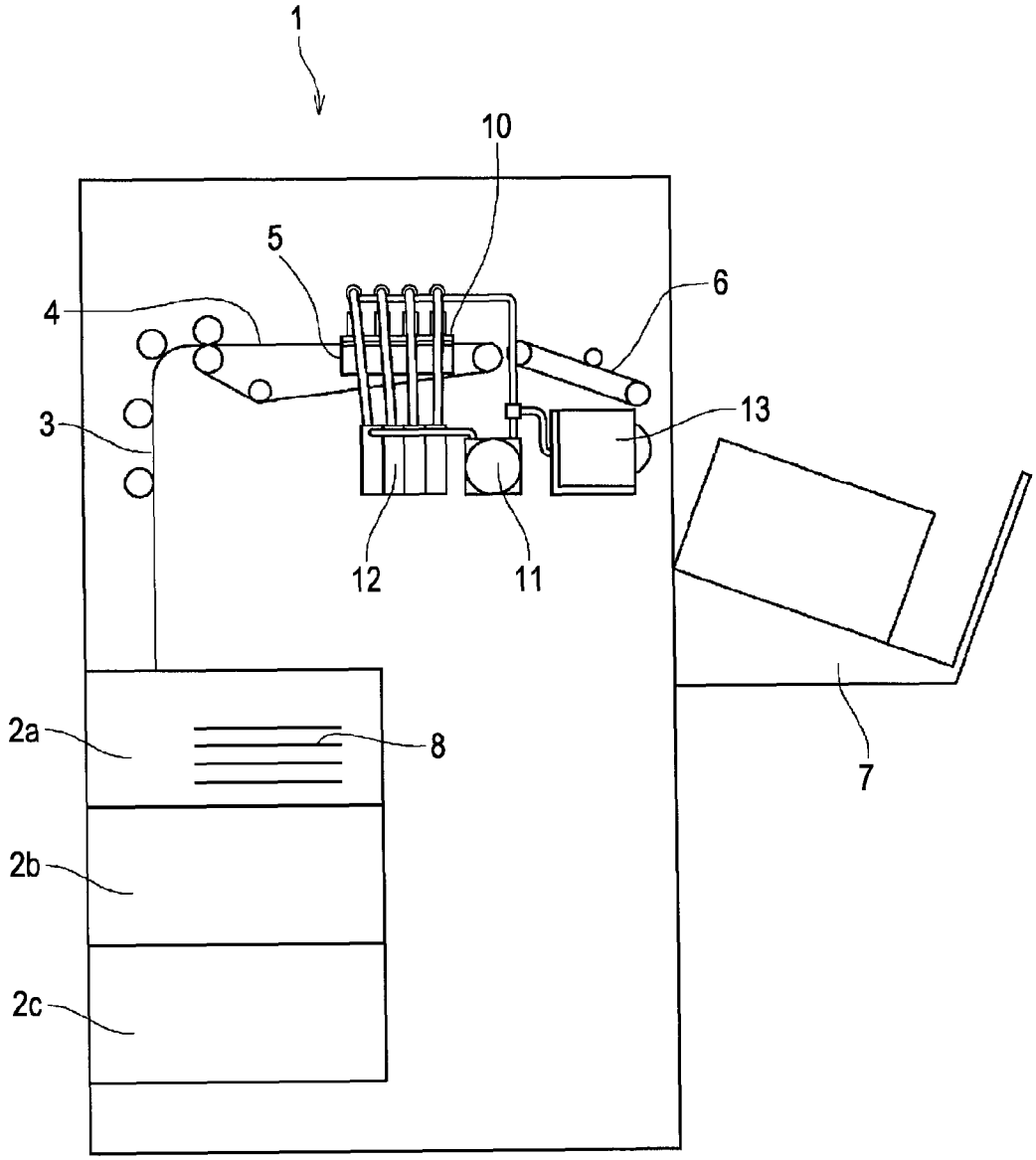
FIG. 1 is a general front view of a line printer according to an embodiment of the present invention.

FIG. 1 is a general front view of the line printer 1 according to the embodiment.

As shown in FIG. 1, the line printer 1 includes a plurality of sheet trays 2*a*, 2*b*, and 2*c*, a conveying unit 3 that conveys each recording sheet 8 selectively supplied from the sheet trays 2*a*, 2*b*, and 2*c* in accordance with the print size, a print table 4 on which the recording sheet 8 faces the line head 10, a maintenance unit 5 that covers an ink discharging surface of the line head 10 in a non-printing state, an output table 6 that conveys the recording sheet 8 after printing, and an output tray 7 for the recording sheet 8.

The line head 10 can perform printing corresponding to the width of the largest recording sheet supplied from the sheet trays 2*a*, 2*b*, and 2*c*. In contrast to a serial-head printer that performs printing by moving a serial head in the width direction of the recording sheet, the line printer 1 does not use any device for moving the line head 10. This can reduce vibration and noise, and can markedly increase the print speed.

Ink can be supplied to the line head 10 by a "head integrated method" in which ink to be supplied is provided in the head, and a "head separate method" in which ink is supplied from the outside. In this embodiment, the line printer 1 adopts a head separate method, and includes an ink cartridge 13 provided separate from the line head 10. The ink cartridge 13 separately stores four color inks Y, M, C, and K, and can be easily loaded in and unloaded from the line printer 1. For this reason, when ink in the ink cartridge 13 is completely consumed, the ink cartridge 13 can be quickly replaced with a new one.

A pump 11 (corresponding to the transfer means in the present invention) is provided between the line head 10 and the ink cartridge 13 via a subtank 12 (corresponding to the pressure adjustment unit in the present invention). By driving the pump 11, ink is supplied from the ink cartridge 13 to the line head 10 with a predetermined pressure.

In order to perform printing with this line printer 1, one recording sheet 8 is selectively conveyed from any of the sheet trays 2*a*, 2*b*, and 2*c* by the conveying unit 3, and is placed on the print table 4. The maintenance unit 5 is separated from the line head 10 so as to expose the ink discharging surface of the line head 10. Color printing is performed by discharging color inks from the line head 10 while moving the recording sheet 8 on the print table 4. After printing, the recording sheet 8 is moved by the output table 6 and is stocked in the output tray 7.

Figure 2:
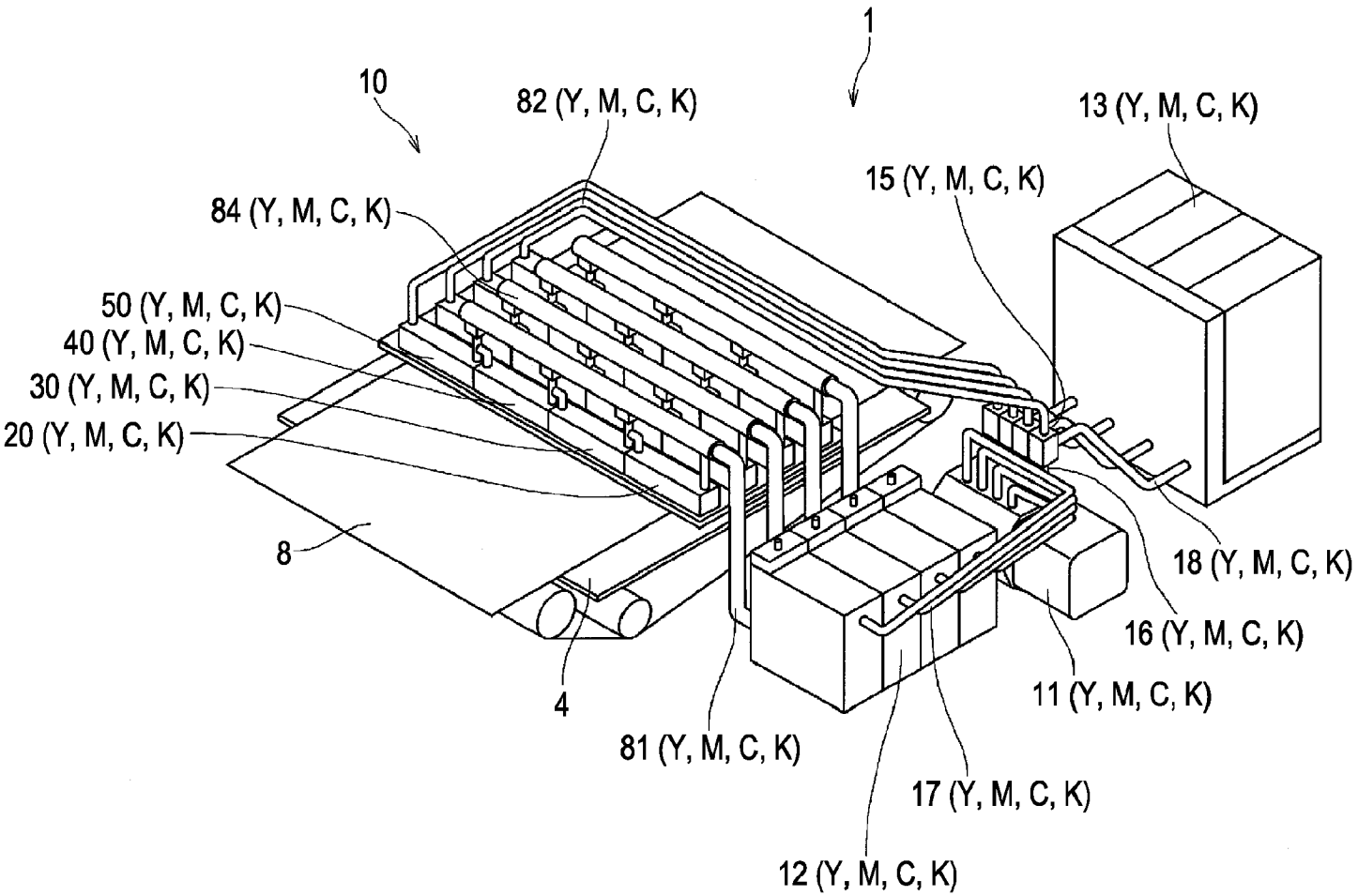
FIG. 2 is a perspective view showing a print section in the line printer.

FIG. 2 is a perspective view of a printing section in the line printer 1.

As shown in FIG. 2, a line head 10 of a module type is disposed in the print section of the line printer 1. In the line head 10, four types of head modules 20, 30, 40, and 50 are arranged in series so as to cover the width of the recording sheet 8 supplied on the print table 4. Four arrays each including a head module 20, a head module 30, a head module 40, and a head module 50 are arranged in parallel so as to respectively discharge four color inks Y, M, C, and K.

Above the head modules 20 (Y, M, C, and K), the head modules 30 (Y, M, C, and K), the head modules 40 (Y, M, C, and K), and the head modules 50 (Y, M, C, and K), ink manifolds 84 (Y, M, C, and K) corresponding to the supply member in the present invention are provided, and ink is supplied thereto.

In this way, the line head 10 includes the four types of head modules 20, 30, 40, and 50 and the ink manifolds 84, and color inks are supplied from the subtanks 12 to the line head 10. That is, the subtanks 12 (Y, M, C, and K) are respectively connected to the ink manifolds 84 (Y, M, C, and K) via supply tubes 81 (Y, M, C, and K). Therefore, four color inks are supplied from the subtanks 12 to the line head 10 by driving the corresponding pumps 11 (Y, M, C, and K).

The four color inks supplied to the line head 10 not only are discharged onto the recording sheet 8 placed on the print table 4, but also are circulated. That is, the color inks from the line head 10 return to the subtanks 12 (Y, M, C, and K) via ejection tubes 82 (Y, M, C, and K), switch valves 15 (Y, M, C, and K), first communication tubes 16 (Y, M, C, and K), the pumps 11 (Y, M, C, and K), and second communication tubes 17 (Y, M, C, and K). Color inks consumed by discharging are replenished from the ink cartridges 13 (Y, M, C, and K) to the subtanks 12 (Y, M, C, and K) via connecting tubes 18 (Y, M, C, and K), the switch valves 15 (Y, M, C, and K), the first communication tubes 16 (Y, M, C, and K), the pumps 11 (Y, M, C, and K), and the second communication tubes 17 (Y, M, C, and K).

Figure 3:
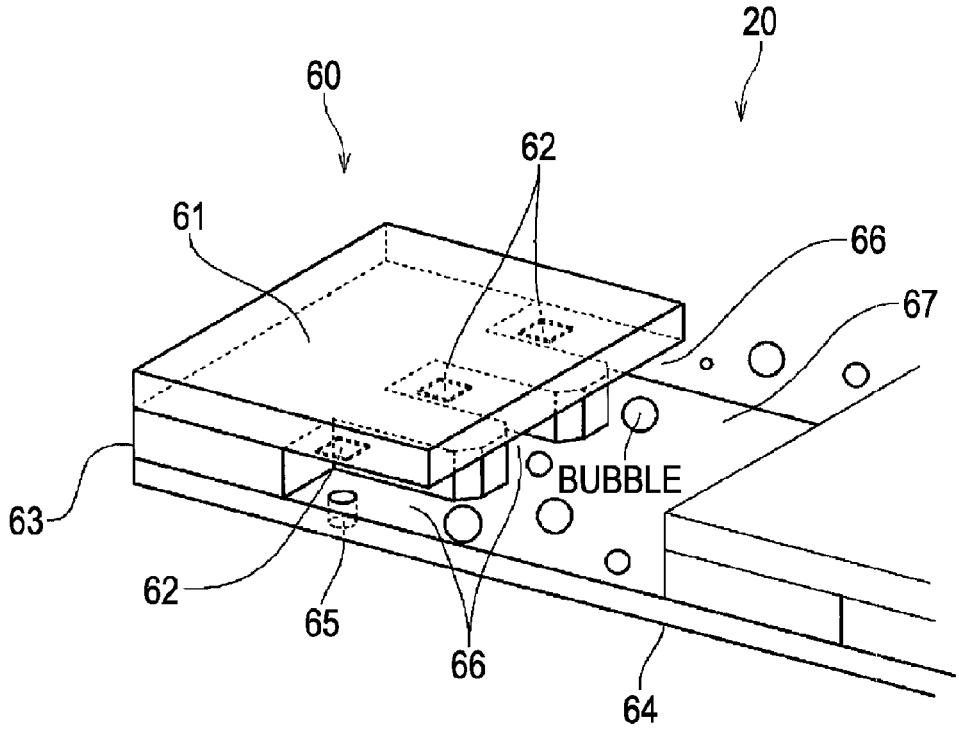
FIG. 3 is a perspective view of an ink discharging section of a head module in a line head of the line printer.

FIG. 3 is a perspective view of an ink discharging section of the head module 20 provided in the line head 10 of the line printer 1.

As shown in FIG. 3, the head module 20 is formed by bonding a head chip 60 and a nozzle sheet 64 together. The head modules 30, 40, and 50 shown in FIG. 2 have a similar structure.

In the head chip 60, a barrier layer 63 is stacked on a semiconductor substrate 61, and the nozzle sheet 64 having nozzles 65 is bonded to the barrier layer 63. A plurality of heating resistors 62 (corresponding to the energy generating element in the present invention) are deposited at regular intervals in one direction on the semiconductor substrate 61. The semiconductor substrate 61, the barrier layer 63, and the nozzle sheet 64 surround the heating resistors 62 so as to define ink chambers 66 (corresponding to the liquid chamber in the present invention). The ink chambers 66 respectively have apertures communicating with a common ink passage 67. Ink is supplied to the ink chambers 66 through the apertures.

The semiconductor substrate 61 is formed of, for example, silicone, glass, or ceramics. The heating resistors 62 are deposited on one surface of the semiconductor substrate 61 by a micro fabrication technology for fabricating semiconductors and electronic devices. The heating resistors 62 are electrically connected to an external circuit via a conductor portion (not shown) provided on the semiconductor substrate 61.

The barrier layer 63 is provided on the surface of the semiconductor substrate 61 having the heating resistors 62. That is, the barrier layer 63 is patterned on a portion of the semiconductor substrate 61 excluding the vicinities of the heating resistors 62 in the following manner. First, photosensitive resin is applied on the entire upper surface of the semiconductor substrate 61, and is exposed via a photomask having a predetermined pattern by an exposure apparatus using light having the best wavelength band for exposure. The exposed photosensitive resin is then developed with a predetermined developing liquid, and an unexposed portion is removed. The semiconductor substrate 61, the heating resistors 62, and the barrier layer 63 constitute the head chip 60.

The nozzle sheet 64 is formed by, for example, electroforming using Ni (nickel). A plurality of nozzles 65 are arranged in the nozzle sheet 64. The head chip 60 (the semiconductor substrate 61, the heating resistors 62, and the barrier layer 63) is precisely positioned so that the nozzles 65 are aligned with the heating resistors 62, that is, so that the nozzles 65 oppose the heating resistors 62. Further, the head chip 60 is bonded onto the nozzle sheet 64 with the barrier layer 63 facing downward.

Therefore, the ink chambers 66 of the head chip 60 are defined by the semiconductor substrate 61, the barrier layer 63, and the nozzle sheet 64 so as to surround the heating resistors 62, as shown in FIG. 3. That is, the semiconductor substrate 61 and the heating resistors 62 form top walls of the ink chambers 66, the barrier layer 63 forms three side walls of each ink chamber 66, and the nozzle sheet 64 forms bottom walls of the ink chambers 66.

The ink chambers 66 respectively have apertures on the lower right side in FIG. 3, and the apertures communicate with the ink common passage 67. For this reason, ink supplied from the subtank 12 (see FIG. 2) is supplied into all the ink chambers 66 via the common passage 67. When a short pulse current (for example, 1 to 3 μsec) is passed through any of the heating resistor 62 according to a command from a control unit (not shown) in a state in which the corresponding ink chamber 66 is filled with ink, the heating resistor 62 is heated rapidly. Then, the ink boils and a bubble is produced in a contact portion between the ink and the heating resistor 62, and a certain volume of ink is pushed away by expansion of the bubble. This pushing force serves as a discharging force, and ink having a volume equivalent to the volume of the pushed ink is discharged in the form of an ink droplet from the nozzle 65, thus performing printing.

If there is a bubble in the ink chamber 66, as shown in FIG. 3, the bubble weakens the ink discharging force because of gas compressibility, and disturbs the ink discharging direction. Further, if the bubble in the ink is expanded by a temperature change due to ink discharging (heating of the heating resistor 62), the ink in the ink chamber 66 is sometimes unintentionally discharged from the nozzle 65. For this reason, the head module 20 not only supplies ink to the ink chambers 66 of the head chip 60 and discharges the ink from the nozzles 65, and also removes ink containing bubbles from the common passage 67.

Figure 4:
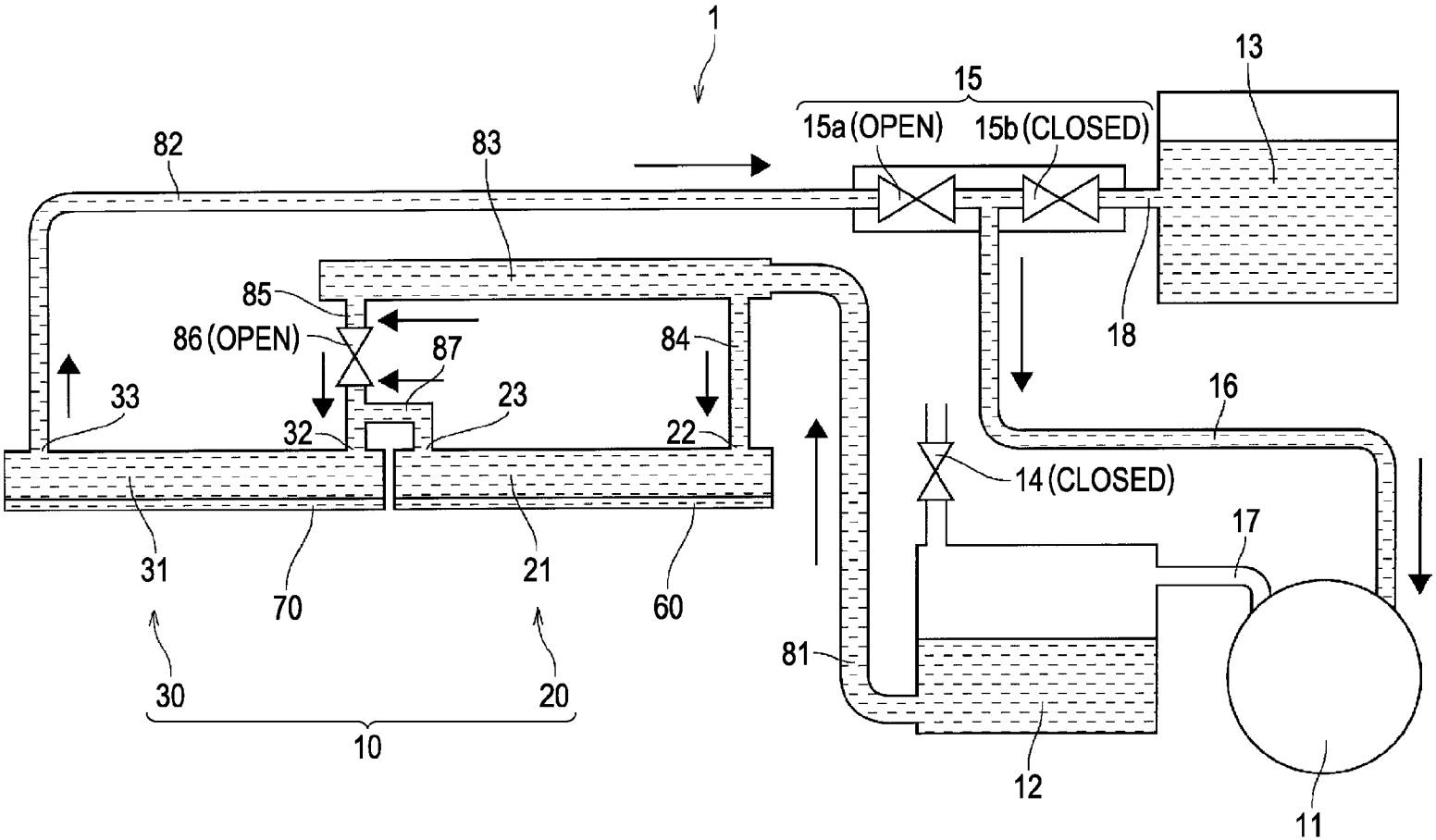
FIG. 4 is a conceptual view showing an ink supply state of the line printer.

FIG. 4 is a conceptual view showing an ink supply state of the line printer 1 according to this embodiment in which bubbles can be removed from the ink.

As shown in FIG. 4, the line printer 1 includes a line head 10 in which two head modules 20 and 30 are arranged, a pump 11 that transfers ink, a subtank 12 that adjusts the pressure of ink to be supplied to the line head 10, and an ink cartridge 13 that stores the ink to be supplied to the line head 10.

The head module 20 includes a head chip 60 and a buffer tank 21 (corresponding to the common passage member in the present invention) for discharging ink, and the head module 30 includes a head chip 70 and a buffer tank 31. For this reason, the line head 10 shown in FIG. 4 includes two (N=2) buffer tanks 21 and 31 (head modules 20 and 30). While the head modules 40 and 50 shown in FIG. 2 are not shown in FIG. 4 for convenience of explanation, basic operations thereof are the same as those of the head modules 20 and 30 as long as the number N of modules is more than or equal to 2. While the line head 10 shown in FIG. 4 discharges ink of one color, its basic operation does not change even when the number of ink colors increases.

The first buffer tank 21 forms a common passage 67 (see FIG. 3) communicating with all ink chambers 66 (see FIG. 3) in the head chip 60, and this also applies to the second (N-th=second) buffer tank 31. The buffer tank 21 (31) includes an inlet 22 (32) through which ink is supplied to the inside, and an outlet 23 (33) through which the ink is discharged from the inside.

The inlet 22 of the first buffer tank 21 is connected to a first supply tube 84 of an ink manifold 83 (corresponding to the supply member in the present invention). The inlet 32 of the second (N-th=second) buffer tank 31 is connected to a second supply tube 85 of the ink manifold 83 via an opening-closing valve 86, and is also connected to the outlet 23 of the first ((N−1)-th) buffer tank 21 via a connecting tube 87. The ink manifold 83 is connected to a supply tube 81 that supplies ink from the subtank 12 to the buffer tank 21 (31).

An ejection tube 82 through which the ink is ejected from the second (N-th=second) buffer tank 31 is connected to the outlet 33 of the buffer tank 31. The ejection tube 82 is connected to the pump 11 via a circulation-side section 15*a* of a switch valve 15 and a first communication tube 16, and the pump 11 is connected to the subtank 12 via a second communication tube 17. The subtank 12 is provided with a communication valve 14 that allows the interior of the subtank 12 to communicate with the atmosphere. A supply-side section 15*b* of the switch valve 15 is connected to a connecting tube 18 that supplies ink stored in the ink cartridge 13.

In order to supply ink from the subtank 12 to the buffer tank 21 (31) in the line printer 1, the supply-side section 15*b* of the switch valve 15 is closed and the circulation-side section 15*a* is opened, as shown in FIG. 4. Subsequently, the communication valve 14 is closed, and the opening-closing valve 86 is opened. These operations may be performed simultaneously or in different orders.

When the pump 11 is driven in this state, air in the buffer tank 21 and air from nozzles 65 (see FIG. 3) of the head chip 60 are transferred into the buffer tank 31 via the connecting tube 87. The air is mixed with air in the buffer tank 31 and air from the head chip 70, passes through the ejection tube 82, the circulation-side section 15*a* of the switch valve 15, the first communication tube 16, the pump 11, and the second communication tube 17, and is accumulated in the subtank 12.

Therefore, the pressure in the subtank 12 increases above the atmospheric pressure. Then, the ink passes through the supply tube 81, and is supplied into the ink manifold 83. The ink in the ink manifold 83 is supplied to the buffer tank 21 via the first supply tube 84, and to the buffer tank 31 via the second supply tube 85 and the opening-closing valve 86. Some ink is supplied from the buffer tank 21 to the buffer tank 31 via the connecting tube 87.

When the ink is supplied to the buffer tank 21 in this way, the nozzles 65 of the head chip 60 are closed by the ink, and no more air enters the nozzles 65. Similarly, when the ink is supplied to the buffer tank 31, air does not enter from the head chip 70. For this reason, the pressure in the subtank 12 does not increase further, but is in equilibrium. Since ink supply from the subtank 12 to the buffer tank 21 (31) is thereby completed, the head chip 60 (70) is allowed to discharge ink.

Figure 5:
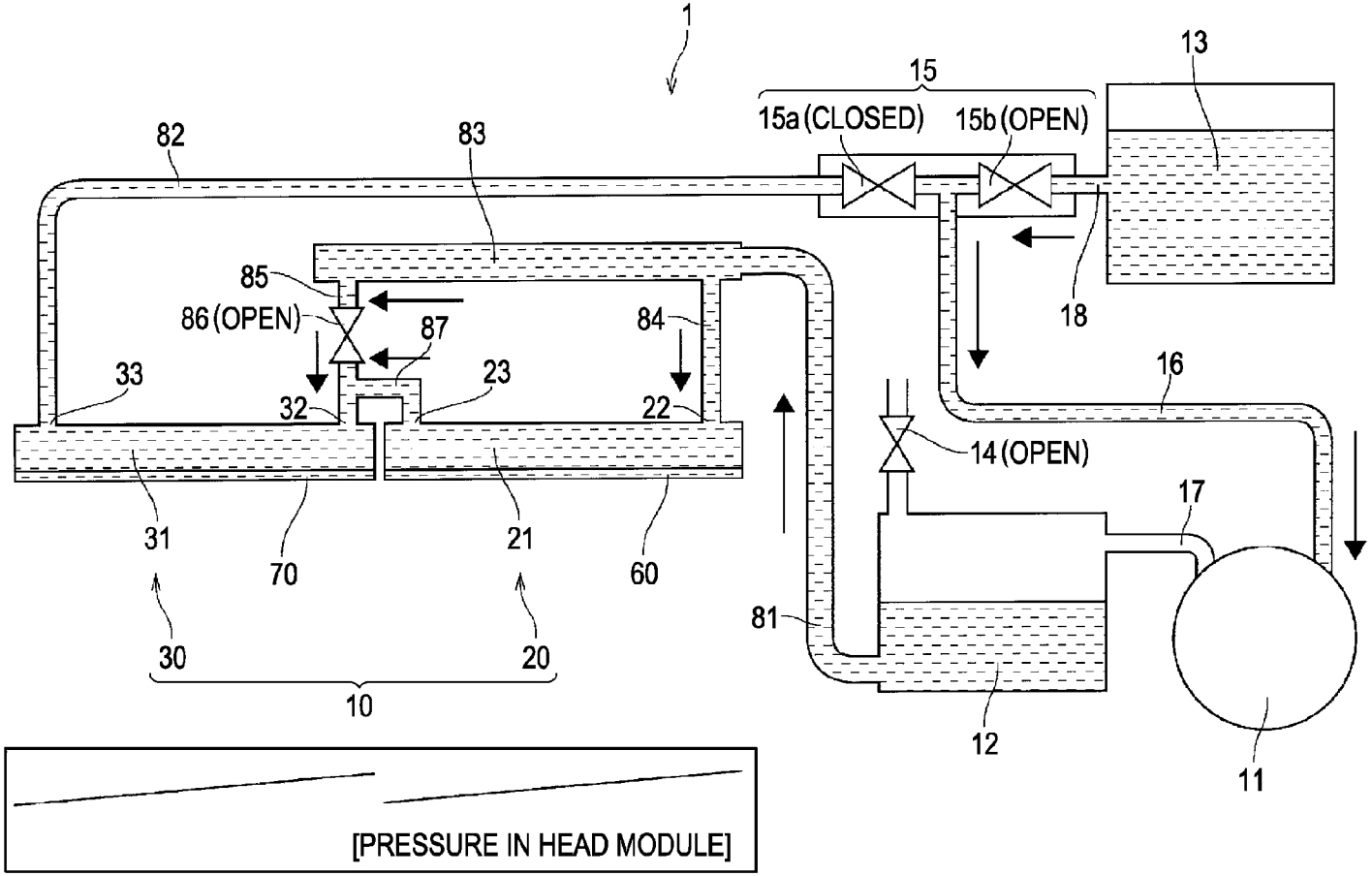
FIG. 5 is a conceptual view showing an ink discharging state of the line printer.

FIG. 5 is a conceptual view showing an ink discharging state of the line printer 1 according to the exemplary embodiment.

In order to perform printing by discharging ink from the head chip 60 (70) in the head module 20 (30) of the line head 10 provided in the line printer 1, the opening-closing valve 86 is opened, the circulation-side section 15*a* of the switch valve 15 is closed, and the supply-side section 15*b* is opened, as shown in FIG. 5. Then, the communication valve 14 is opened, and heating resistors 62 (see FIG. 3) in the head chip 60 are driven in this state. Consequently, a discharging force is applied to the ink in the ink chambers 66, and the ink is discharged from the ink chambers 66 through the nozzles 65. Similarly to the head chip 60, ink is also discharged from the head chip 70.

In a case in which the amount of ink discharged from the head chip 60 is almost the same as the amount of ink discharged from the head chip 70, ink consumed in the head module 20 is sequentially replenished from the subtank 12 via the supply tube 81, the first supply tube 84, and the inlet 22 of the buffer tank 21, as shown by the arrows in FIG. 5.

In contrast, ink consumed in the head module 30 is sequentially replenished from the subtank 12 via the supply tube 81, the ink manifold 83, the second supply tube 85, the opening-closing valve 86, and the inlet 32 of the buffer tank 31, as shown by the arrows in FIG. 5. In this case, little ink is replenished via the supply tube 81, the first supply tube 84, the buffer tank 21, and the connecting tube 87 because the pressure loss in the ink manifold 83 is smaller than the pressure loss in the buffer tank 21 and the buffer tank 31. The pressure loss in the ink manifold 83 can be reduced, for example, by making the passage cross-sectional area of the ink manifold 83 larger than that of the buffer tanks 21 and 31, or by reducing the number of bent and narrow portions in the ink manifold 83.

Even when the ink discharging amount of the head chip 60 is more than that of the head chip 70, ink consumed in the head module 20 is sequentially replenished via the supply tube 81 and the first supply tube 84. Therefore, the pressure in the head module 20 automatically approaches the pressure in the head module 30.

Conversely, when the ink discharging amount of the head chip 70 is more than that of the head chip 60, ink consumed in the head module 30 is replenished not only via the supply tube 81, the ink manifold 83, the second supply tube 85, and the opening-closing valve 86, but also via the supply tube 81, the first supply tube 84, the buffer tank 21, and the connecting tube 87, as shown by the arrows in FIG. 5. For this reason, the pressure in the head module 30 rapidly approaches the pressure in the head module 20.

In this way, in the line printer 1 according to the exemplary embodiment, even when the ink discharging amounts of the head modules 20 and 30 in the line head 10 are different, the pressures in the head modules 20 and 30 display just the same tendency while they are reduced by pressure loss, as shown in FIG. 5. For this reason, ink is stably supplied with a similar pressure to the head modules 20 and 30. As a result, a difference is not formed between the ink discharging performance of the head chip 60 and the ink discharging performance of the head chip 70.

When the subtank 12 runs short of ink because of ink consumption in the head modules 20 and 30, ink can be added to the subtank 12 by driving the pump 11 while exerting little influence on ink discharging of the head chip 60 (70). That is, as shown by the arrows in FIG. 5, ink in the ink cartridge 13 is supplied into the subtank 12 via the connecting tube 18, the supply-side section 15*b* of the switch valve 15, the first communication tube 16, the pump 11, and the second communication tube 17 by driving the pump 11.

An ink-amount measuring device (not shown) is attached to the subtank 12, and outputs an ink-amount limit signal when the level of ink in the subtank 12 reaches a predetermined ink level. When the control unit (not shown) receives this limit signal, it issues a command to the pump 11. According to the command, the pump 11 automatically stops, and the addition of ink to the subtank 12 is completed. This ink supply to the subtank 12 is also automatically performed when the subtank 12 is empty of ink, for example, when the line printer 1 is first started.

Therefore, a predetermined amount of ink is constantly stored in the subtank 12, and the ink is stably supplied to the head modules 20 and 30. This allows the line printer 1 to achieve high-quality printing. In order to maintain the high quality, it is necessary to sufficiently remove bubbles from the ink.

Figure 6:
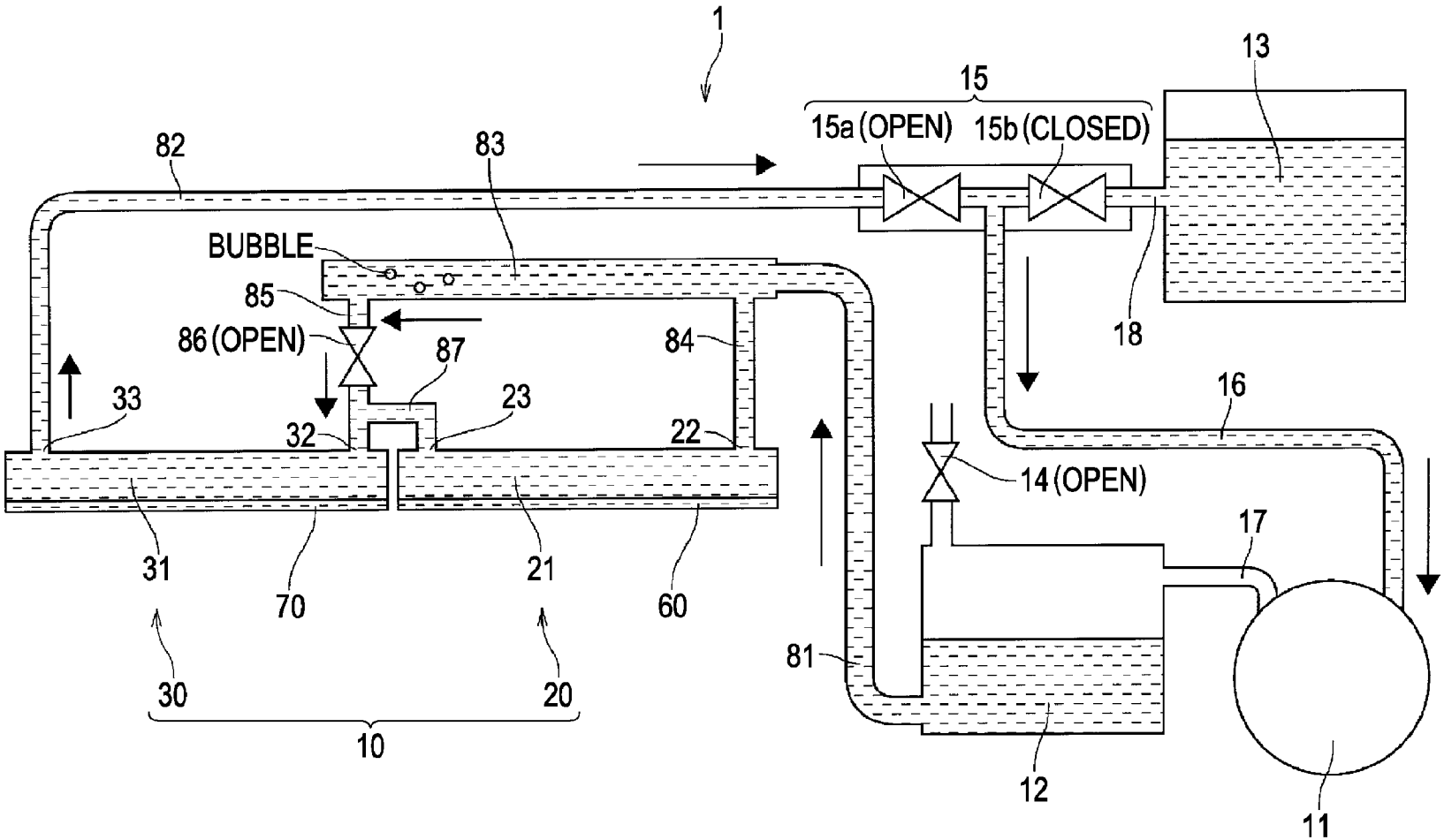
FIG. 6 is a conceptual view showing a manifold bubble removing state of the line printer.

FIG. 6 is a conceptual view showing a manifold bubble removing state of the line printer 1 according to the exemplary embodiment.

In the line printer 1, bubbles are removed from the ink by circulating the ink. For bubble removal, air remaining in the ink manifold 83 is exhausted first.

In order to exhaust air from the ink manifold 83 by circulating the ink, the opening-closing valve 86 is opened, the circulation-side section 15*a* of the switch valve 15 is opened, the supply-side section 15*b* is closed, and the communication valve 14 is opened. By opening the communication valve 14, the entire ink circulation path is brought into a state in which the pressure is fixed in accordance with the ink level in the subtank 12.

When the pump 11 is driven in this state, the ink from the subtank 12 principally circulates via the supply tube 81, the ink manifold 83, the second supply tube 85, the opening-closing valve 86, the buffer tank 31, the ejection tube 82, the circulation-side section 15*a* of the switch valve 15, the first communication tube 16, the pump 11, and the second communication tube 17, and then returns to the subtank 12. For this reason, when air remains in the ink manifold 83, it is transferred to the subtank 12, and is exhausted into the atmosphere through the communication valve 14. After the air is thus exhausted from the ink manifold 83, bubbles are removed from the ink in the buffer tank 21 (31).

Figure 7:
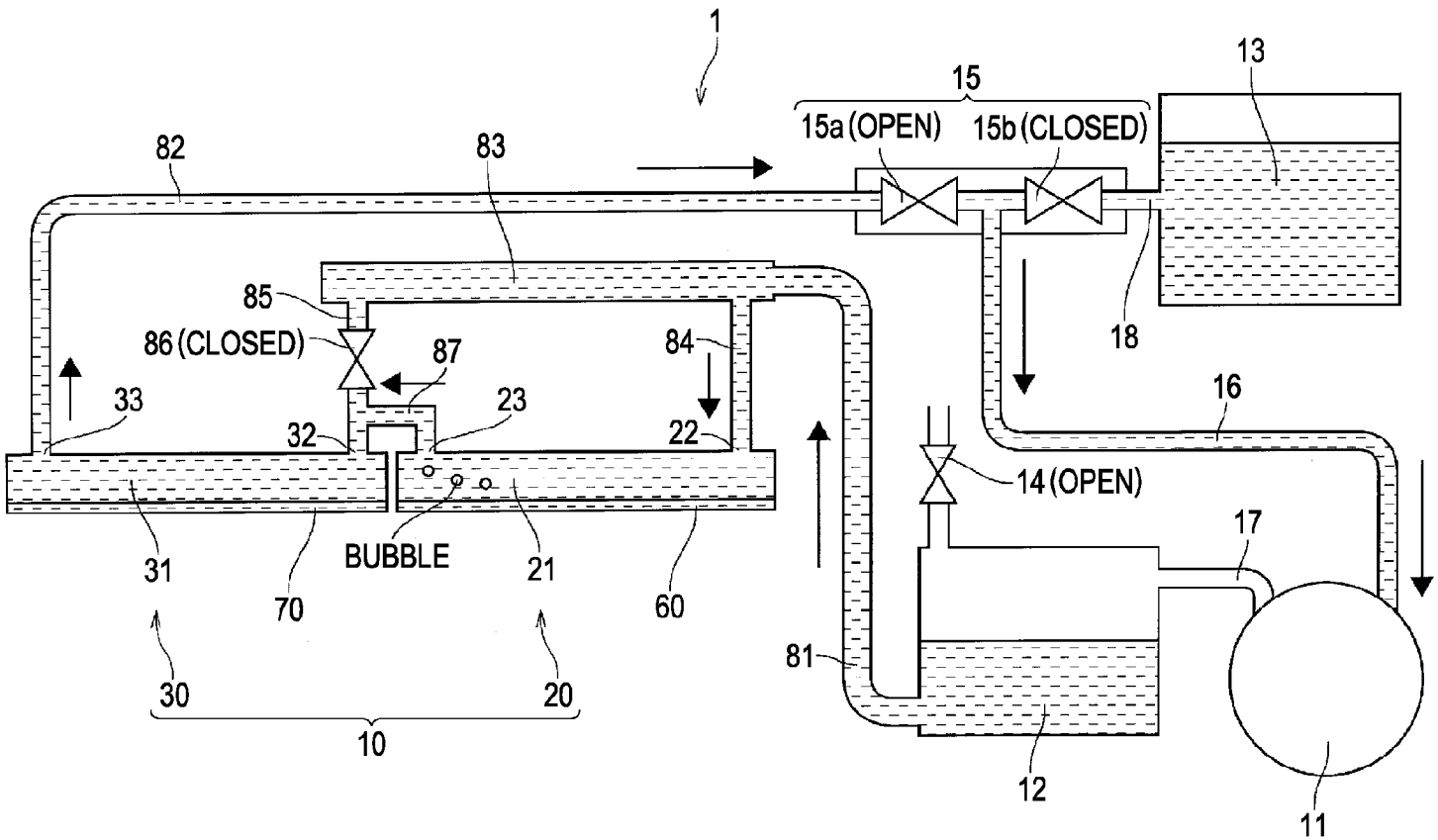
FIG. 7 is a conceptual view showing a buffer-tank bubble removing state of the line printer.
Figure 8:
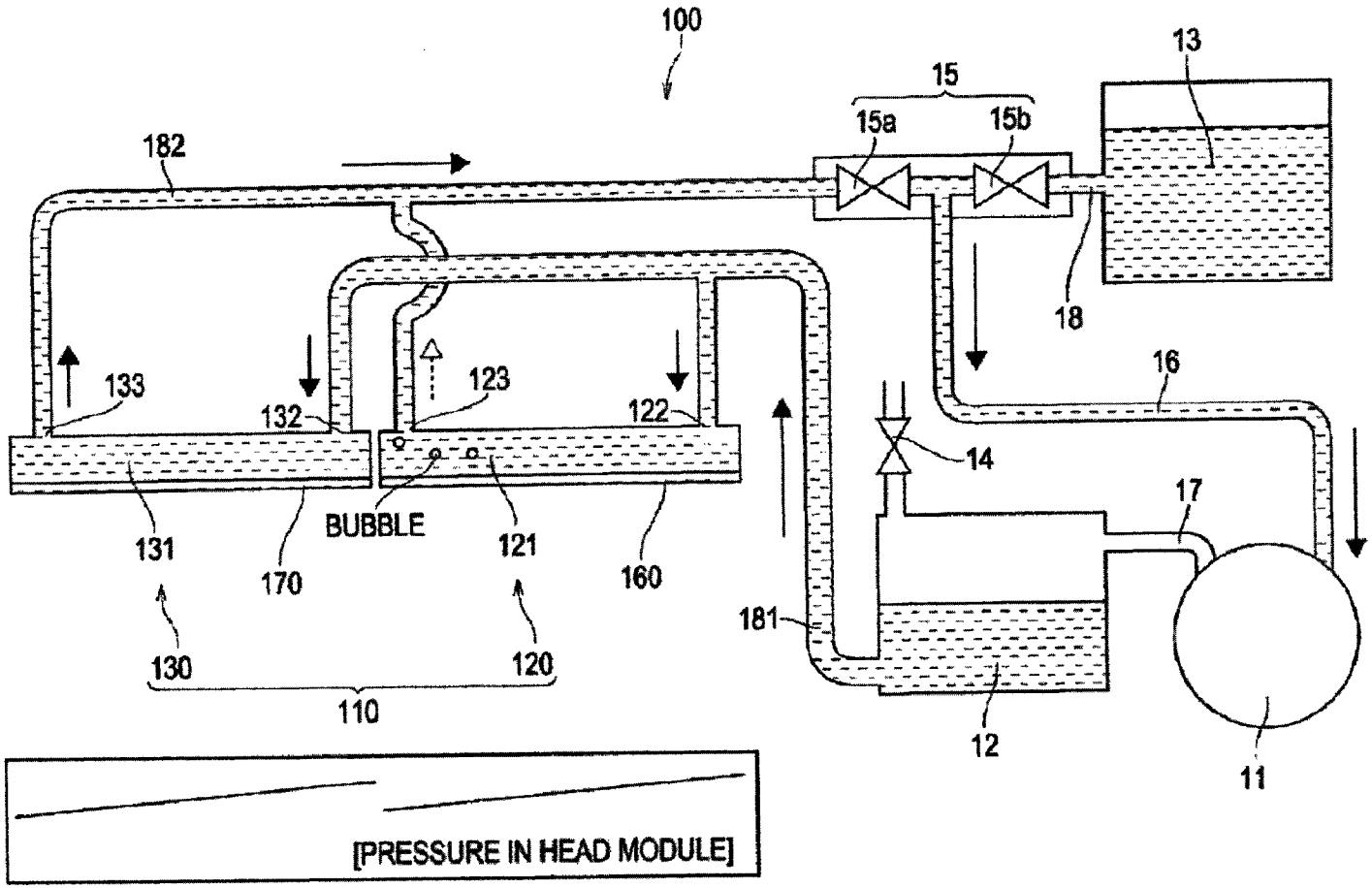
PRIOR ART FIG. 8
FIG. 8 is a conceptual view of a line printer as the related art.
Figure 9:
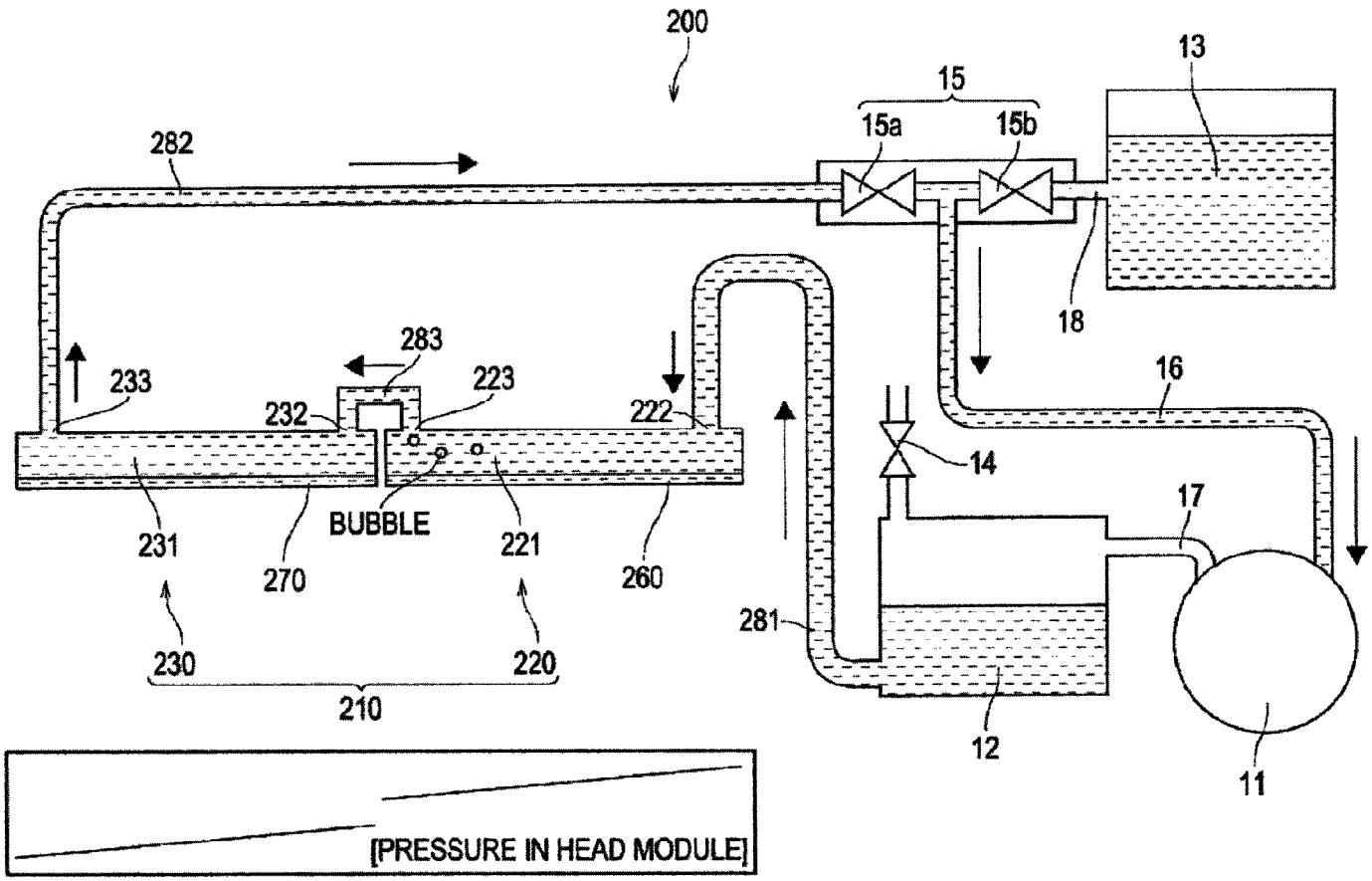
PRIOR ART FIG. 9
FIG. 9 is a conceptual view of a line printer as a comparative example.

FIG. 7 is a conceptual view showing a buffer-tank bubble removing state of the line printer 1.

In order to remove bubbles from ink in the buffer tank 21 (31), the ink is circulated, in a manner similar to that adopted in the above-described manifold bubble removing operation.

During the buffer-tank bubble removing operation, the opening-closing valve 86 is closed to circulate the ink in the buffer tank 21 (31). Except that the opening-closing valve 86 is closed, the circulation-side section 15*a* of the switch valve 15 is opened, the supply-side section 15*b* is closed, and the communication valve 14 is opened, in a manner similar to that adopted in the manifold bubble removing operation.

When the pump 11 is driven in this state, the ink flows from the subtank 12 into the supply tube 81, as shown by the arrow in FIG. 7, but does not further flow into the ink manifold 83, passes only through the first supply tube 84, and is supplied into the common passage of the buffer tank 21 through the inlet 22. Then, ink containing bubbles in the buffer tank 21 is transferred in accordance with the supply pressure, and is ejected from the outlet 23. The ejected ink is then supplied to the common passage of the buffer tank 31 via the connecting tube 87 and the inlet 32. For this reason, ink in the buffer tank 31 is also transferred in accordance with the supply pressure, and is ejected from the outlet 33. The ejected ink returns to the subtank 12 via the ejection tube 82, the circulation-side section 15*a* of the switch valve 15, the first communication tube 16, the pump 11, and the second communication tube 17. In the subtank 12, bubbles are removed from the ink.

Therefore, in the line printer 1, the ink circulates, as shown by the arrows in FIG. 7, by driving the pump 11 with the opening-closing valve 86 closed, and bubbles are removed from the buffer tank 21. That is, the bubbles contained in the ink in the common passage of the buffer tank 21 are transferred to the subtank 12 via the common passage of the buffer tank 31, and are released into the atmosphere through the communication valve 14. If the opening-closing valve 86 is opened, the ink circulates via both the ink manifold 83 and the buffer tank 21. Therefore, when the communication tube 87 and the like are closed by the bubbles, the ink transfer resistance increases at the closed portions. As a result, the ink is mainly transferred via the ink manifold 83, the ink in the buffer tank 21 is not transferred, and a lot of bubbles stay in the ink in the buffer tank 21.

In the line printer 1, even when bubbles are contained in the ink in the common passage of the buffer tank 31, the ink is transferred to the subtank 12 and is removed by driving the pump 11. Even when the bubbles in the ink form an air accumulation, the ink in the common passages of the buffer tanks 21 and 31 are similarly circulated by closing the opening-closing valve 86. Therefore, the bubbles are smoothly removed from the ink in the line head 10.

In order to remove bubbles from the ink in the buffer tank 21 (31), the ink is thus circulated while the opening-closing valve 86 is closed. This allows the ink to always pass through the common passages of the buffer tanks 21 and 31. For this reason, the ink containing bubbles in the head modules 20 and 30 is easily transferred, and the bubbles are removed from the ink at the subtank 12.

Since the ink can be circulated by the single pump 11, the line printer 1 can remove the bubbles at low cost. Further, when ink is discharged from the head chip 60 (70) of the head module 20 (30), ink can be stably supplied to the head modules 20 and 30 with a similar pressure by opening the opening-closing valve 86. This improves the print quality.

While the exemplary embodiment of the present invention has been described above, the present invention is not limited to the above exemplary embodiment. For example, the following various modifications can be made.

(1) While the line head 10 in the exemplary embodiment includes two (N=2) buffer tanks 21 and 31 (head modules 20 and 30) (in FIG. 2, the line head 10 includes the head modules 20, 30, 40, and 50), the number N of buffer tanks is not limited as long as it is more than or equal to two. That is, as long as the number N is more than or equal to two, high-quality printing can be achieved by sufficient removal of bubbles and stable ink supply. Moreover, the ink can be circulated with a reduced number of pumps, and therefore, the cost is reduced.

(2) While the inkjet line printer 1 in the exemplary embodiment includes the line head 10 having the length corresponding to the print width, the present invention is not limited to this printer, but is widely applied to other liquid discharging apparatuses for discharging various kinds of liquids. For example, the present invention is also applicable to a liquid discharging apparatus that discharges dye onto goods.

What is claimed is:

1. A liquid discharging head comprising: a head chip including a plurality of energy generating elements configured to discharge liquid, and liquid chambers provided around the corresponding energy generating elements; and a common passage member configured to define a common passage communicating with all the liquid chambers in the head chip, wherein, the liquid is discharged from the liquid chambers by driving the energy generating elements so as to apply a discharging force to the liquid in the liquid chambers, wherein the common passage member includes N-number of common passage members, the value N is more than or equal to two, and each of the common passage members includes an inlet through which the liquid is supplied to the common passage and an outlet through which the liquid is ejected from the common passage, the inlet of the first common passage member is connected to a liquid supply member, the inlet of the N-th common passage member is connected to the liquid supply member via an opening-closing valve and to the outlet of the (N−1)-th common passage member, and a pressure loss of the liquid supply member between the inlet of the first common passage member and the inlet of the N-th common passage member is less than the total pressure loss of the common passages between the inlet of the first common passage member and the inlet of the N-th common passage member.

2. A liquid discharging apparatus comprising:

a head chip including a plurality of energy generating elements configured to discharge liquid and liquid chambers provided around the corresponding energy generating elements; and a common passage member configured to define a common passage communicating with all the liquid chambers in the head chip, wherein the liquid is discharged from the liquid chambers by driving the energy generating elements so as to apply a discharging force to the liquid in the liquid chambers, wherein, the common passage member includes N-number of common passage members, the value N is more than or equal to two, and each of the common passage members includes an inlet through which the liquid is supplied to the common passage and an outlet through which the liquid is ejected from the common passage, the inlet of the first common passage member is connected to a liquid supply member, the inlet of the N-th common passage member is connected to the liquid supply member via an opening-closing valve and to the outlet of the (N−1)-th common passage member, and the liquid discharging apparatus further includes a transfer device configured to transfer the liquid from the inlet of the first common passage member toward the outlet of the N-th common passage member.

3. The liquid discharging apparatus according to claim 2, further comprising pressure adjustment means provided between the transfer device and the liquid supply member and configured to adjust the pressure of liquid to be supplied to the common passages of the common passage members, wherein, the transfer device is connected to the outlet of the N-th common passage member, and wherein the liquid in the common passages of the common passage members is circulated via the pressure adjustment means by the transfer device.

4. The liquid discharging apparatus according to claim 2, further comprising pressure adjustment means connected to the liquid supply member and configured to adjust the pressure of liquid to be supplied to the common passages of the common passage members.

5. A liquid discharging apparatus comprising:

a head chip including a plurality of energy generating elements configured to discharge liquid and liquid chambers provided around the corresponding energy generating elements;

N-number of common passage members each configured to define a common passage communicating with all the liquid chambers in the head chip and each including an inlet through which the liquid is supplied to the common passage and an outlet through which the liquid is ejected from the common passage, the value N being more than or equal to two; and a transfer device configured to transfer the liquid from the inlet of the first common passage member toward the outlet of the N-th common passage member, a bubble is removed from the liquid in the common passages of the common passage members by transferring the liquid by the transfer device, the inlet of the first common passage member is connected to a liquid supply member, wherein the inlet of the N-th common passage member is connected to the ink supply member via an opening-closing valve and to the outlet of the (N−1)-th common passage member, the liquid is transferred by driving the transfer device while the opening-closing valve is opened when the liquid is discharged from the liquid chambers by driving the energy generating elements in the head chip so as to apply a discharging force to the liquid in the liquid chambers, and the liquid is transferred by driving the transfer device while the opening-closing valve is closed when the bubble is removed from the liquid in the common passages of the common passage members.

6. The liquid discharging apparatus according to claim 2, wherein a pressure loss of the liquid supply member between the inlet of the first common passage member and the inlet of the N-th common passage member is less than the total pressure loss of the common passages between the inlet of the first common passage member and the inlet of the N-th common passage member.

7. The liquid discharging apparatus according to claim 5, wherein a pressure loss of the liquid supply member between the inlet of the first common passage member and the inlet of the N-th common passage member is less than the total pressure loss of the common passages between the inlet of the first common passage member and the inlet of the N-th common passage member.

* * * * *